US011603665B2

(12) United States Patent
Jang

(10) Patent No.: US 11,603,665 B2
(45) **Date of Patent: *Mar. 14, 2023**

(54) HOLLOW BRICK WITH HOLDING RIBS

(71) Applicant: Kuan-Chih Jang, Kaohsiung (TW)

(72) Inventor: Kuan-Chih Jang, Kaohsiung (TW)

( * ) Notice: Subject to any disclaimer, the term of this patent is extended or adjusted under 35 U.S.C. 154(b) by 15 days.

This patent is subject to a terminal disclaimer.

(21) Appl. No.: 17/407,751

(22) Filed: Aug. 20, 2021

(65) Prior Publication Data

US 2021/0381243 A1 Dec. 9, 2021

Related U.S. Application Data

(63) Continuation-in-part of application No. 16/554,844, filed on Aug. 29, 2019, now abandoned.

(30) Foreign Application Priority Data

Dec. 18, 2018 (TW) ..... 107145717

(51) Int. Cl.
*E04D 13/17* (2006.01)
*E04D 11/00* (2006.01)

(52) U.S. Cl.
CPC ..... *E04D 13/172* (2013.01); *E04D 11/005* (2013.01)

(58) Field of Classification Search
CPC ..... E04C 1/24; E04C 1/34; E04C 1/36; E04C 1/38; E04C 1/39; E04C 1/397;
(Continued)

(56) References Cited

U.S. PATENT DOCUMENTS 1,451,340 A 4/1923 Leo
1,481,249 A * 1/1924 Beinecke ..... E04B 2/42 52/444

(Continued)

FOREIGN PATENT DOCUMENTS

CN 2320693 Y 5/1999
CN 1293295 A 5/2001

(Continued)

OTHER PUBLICATIONS

Taiwan Patent Office, "Search Report appended to an Office Action", which was issued to Taiwanese counterpart application No. 107145721, document of 2 pages, dated Nov. 27, 2019.

(Continued)

*Primary Examiner* — Theodore V Adamos
(74) *Attorney, Agent, or Firm* — Akerman LLP; Peter A. Chiabotti

(57) ABSTRACT

A hollow brick includes a bottom wall, two side walls, two intermediate walls, and a top wall. The top wall defines three arched top boundary surfaces of three ventilation holes bounded by the bottom wall, the side walls, the intermediate walls and the top wall. Two supports, each of which supports a first corrugated plate, project from the side walls. Two inner holding ribs are in two ventilation holes respectively proximal to the side walls and lie below the arched top boundary surfaces. A middle one of the arched top boundary surfaces abuts and presses a curved middle portion of a second corrugated plate, and the inner holding ribs respectively lift lateral portions of the second corrugated plate.

6 Claims, 10 Drawing Sheets

(58) Field of Classification Search
CPC ..... E04C 1/392; E04C 1/41; E04C 11/005; E04D 11/00; E04D 13/172
USPC ..... 52/606, 607, 503, 504, 505
See application file for complete search history.

(56) References Cited

U.S. PATENT DOCUMENTS

| | | | | |
|---|---|---|---|---|
| 1,524,612 | A * | 1/1925 | Anderson | E04H 7/28 52/442 |
| 1,720,306 | A | 7/1929 | Tremper | |
| 2,074,592 | A * | 3/1937 | Rowell | E04H 7/28 52/192 |
| 2,126,394 | A * | 8/1938 | Jansen | E04B 2/14 52/373 |
| 2,194,047 | A | 3/1940 | Markle | |
| 2,198,688 | A | 4/1940 | Wilson | |
| 2,199,946 | A | 5/1940 | Barnhart | |
| 2,451,392 | A | 10/1948 | Kennedy | |
| 2,552,712 | A | 5/1951 | Hite | |
| 3,220,715 | A * | 11/1965 | Kinney | C21B 9/06 52/607 |
| 3,461,631 | A | 8/1969 | Brugnola et al. | |
| 4,058,948 | A | 11/1977 | Warren | |
| 4,485,604 | A * | 12/1984 | Palamara | E04C 1/39 52/436 |
| 4,535,579 | A * | 8/1985 | Burgoyne | E04D 11/00 52/408 |
| 4,566,235 | A * | 1/1986 | Groll | E04F 15/18 52/607 |
| 4,601,150 | A | 7/1986 | Dougherty | |
| 4,698,949 | A | 10/1987 | Dietrich | |
| 5,410,848 | A * | 5/1995 | McClinton | E04C 1/42 52/610 |
| 5,575,128 | A * | 11/1996 | Haener | E04B 2/18 52/286 |
| 5,715,635 | A | 2/1998 | Sherwood | |
| 6,280,121 | B1 | 8/2001 | Khamis | |
| 6,889,479 | B2 | 5/2005 | Thorpe | |
| 7,775,747 | B2 | 8/2010 | Bott | |
| 8,132,988 | B2 | 3/2012 | Dawson et al. | |
| 9,038,346 | B1 * | 5/2015 | Wauhop | E04B 2/18 52/592.6 |
| 9,863,145 | B2 | 1/2018 | Genest et al. | |
| 10,787,815 | B2 * | 9/2020 | Jang | F24F 7/02 |
| 10,883,268 | B2 * | 1/2021 | Jang | E04D 11/005 |
| 2006/0150559 | A1 | 7/2006 | Haener | |
| 2006/0168907 | A1 | 8/2006 | Thorpe | |
| 2013/0152489 | A1 * | 6/2013 | Weber | E04B 2/52 52/588.1 |
| 2015/0308698 | A1 * | 10/2015 | Weber | F24D 3/145 52/173.1 |
| 2015/0368901 | A1 | 12/2015 | Weber | |
| 2017/0145690 | A1 | 5/2017 | Genest | |
| 2020/0190808 | A1 | 6/2020 | Jang | |

FOREIGN PATENT DOCUMENTS

| | | | |
|---|---|---|---|
| CN | 1936233 | A | 3/2007 |
| CN | 200996182 | Y | 12/2007 |
| CN | 202689299 | U | 1/2013 |
| CN | 103669679 | A | 3/2014 |
| CN | 104912253 | A | 9/2015 |
| CN | 209538533 | U | 10/2019 |
| DE | 2435490 | A1 | 2/1976 |
| GB | 190204358 | A | 4/1902 |
| JP | 2018013008 | A | 1/2018 |
| TW | 423545 | | 2/2001 |
| TW | M287339 | | 2/2006 |
| TW | I604112 | A | 11/2017 |
| TW | M577034 | A | 4/2019 |

OTHER PUBLICATIONS

Taiwan Patent Office, "Search Report appended to an Office Action", which was issued to Taiwanese counterpart application No. 107145717, document of 2 pages, dated Oct. 24, 2019.
Search Report appended to an Office Action, which was issued to Chinese counterpart application No. 200910083602.0 by the CNIPA dated Dec. 25, 2020, with an English translation thereof.
Notice of Allowance issued to Chinese counterpart application No. 200910083602.0 by the CNIPA dated Jan. 20, 2022, with an English translation thereof.

* cited by examiner

HOLLOW BRICK WITH HOLDING RIBS

CROSS-REFERENCE TO RELATED APPLICATION

This is a continuation-in-part application of U.S. patent application Ser. No. 16/554,844, filed on Aug. 29, 2019, which claims priority to Taiwanese Patent Application No. 107145717, filed on Dec. 18, 2018.

FIELD

The disclosure relates to a brick, and more particularly to a hollow brick usable on a rooftop for heat insulation.

BACKGROUND

As shown in FIGS. 1 to 3, an existing brick 1 includes a main body 11, and a top plate 12 that is made of porous material and that covers the main body 11. The main body 11 has a bottom wall 110, a surrounding wall 111 extending around from the bottom wall 110, an inner space 100 defined by the bottom wall 110 and the surrounding wall 111, a plurality of partition plates 112 disposed in and dividing the inner space 100 into a plurality of compartment sections 101, and a plurality of spaced-apart ventilation recesses 113 indented into outer surfaces of the surrounding wall 111 and the bottom wall 110 and elongated from bottom wall 110 to a top of the surrounding wall 111.

FIG. 3 illustrates that a plurality of the bricks 1 are juxtaposed with each other and arranged in rows and columns to form a heat-insulation structure for a rooftop. Because the top plate 12 is porous, the compartment sections 101 can collect and store rainwater while the ventilation recesses 113 may provide ventilation.

However, because the surrounding walls 111 of the bricks 1 are not provided with interconnecting structures, when a number of bricks 1 are juxtaposed with each other, they fail to form an integrally interconnected structure. Due to lack of connecting strength, utilizing the bricks 1 may encounter insecurity problems. Further, though the top plate 12 is porous, because the compartment sections 101 collect and store rainwater, the compartment sections 101 may not be well ventilated. Even if the bricks 1 can be well ventilated vertically or along a top-bottom direction, ventilation along a horizontal direction is impossible for the bricks 1, thereby reducing head-insulation and heat dissipation effects.

SUMMARY

Therefore, an object of the disclosure is to provide a hollow brick to alleviate at least one of the drawbacks of the prior art.

According to the disclosure, provided is a hollow brick that is configured to be assembled with a first corrugated plate and a second corrugated plate on a rooftop. Each of two opposite sides of the first corrugated plate has a curved connection portion, an extension portion extending outwardly from the curved connection portion and a curved insertion portion curvedly and upwardly extending from the extension portion opposite to the curved connection portion. The second corrugated plate has two lateral portions and a curved middle portion between the lateral portions.

The hollow brick includes a bottom wall, two side walls, two intermediate walls, a top wall, three ventilation holes, two supports, and two inner holding ribs.

The bottom wall has two opposite longitudinal sides and two opposite transverse sides connected between the longitudinal sides.

The two side walls respectively and upwardly project from two opposite transverse sides of the bottom wall.

The two intermediate walls project upwardly from the bottom wall between the side walls and are spaced apart along a direction parallel with the longitudinal sides of the bottom wall.

The top wall is opposite to the bottom wall and connects the side walls and the intermediate walls.

The three ventilation holes are bounded by the bottom wall, the side walls, the intermediate walls and the top wall. Each of the ventilation holes has two ventilation open ends opposite to each other along a line parallel with the transverse sides of the bottom wall. A bottom side of the top wall defines three arched top boundary surfaces each of which is concaved upwardly to bound a top portion of one of the ventilation holes.

Each of the two supports has an outer holding rib and an outer flange. The outer holding ribs of the two supports project respectively from outer surfaces of the side walls in opposite outward directions. The outer flanges of the two supports respectively project in opposite outward directions from the outer surfaces of the side walls at a level above the outer holding ribs. The outer holding rib and the outer flange of each of the supports are proximal to the top wall and cooperatively define a space therebetween. One of the outer ribs is adapted to lift the extension portion of the first corrugated plate whereas one of the outer flanges is adapted to press the curved connection portion of the first corrugated plate. The arched top boundary surface of one of the ventilation holes adjacent to one of the side walls are adapted to abut and press the curved insertion portion of the first corrugated plate when the curved insertion portion is inserted therein.

The two inner holding ribs are respectively disposed in two of the ventilation holes respectively proximal to the side walls. Each of the inner holding ribs projects from one of the intermediate walls toward an adjacent one of the side walls. Each of the inner holding ribs lies at a level below a respective one of the arched top boundary surfaces.

The arched top boundary surface of one of the ventilation holes between the intermediate walls is adapted to abut and press the curved middle portion of the second corrugated plate, and the inner holding ribs are adapted to respectively lift the lateral portions of the second corrugated plate.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
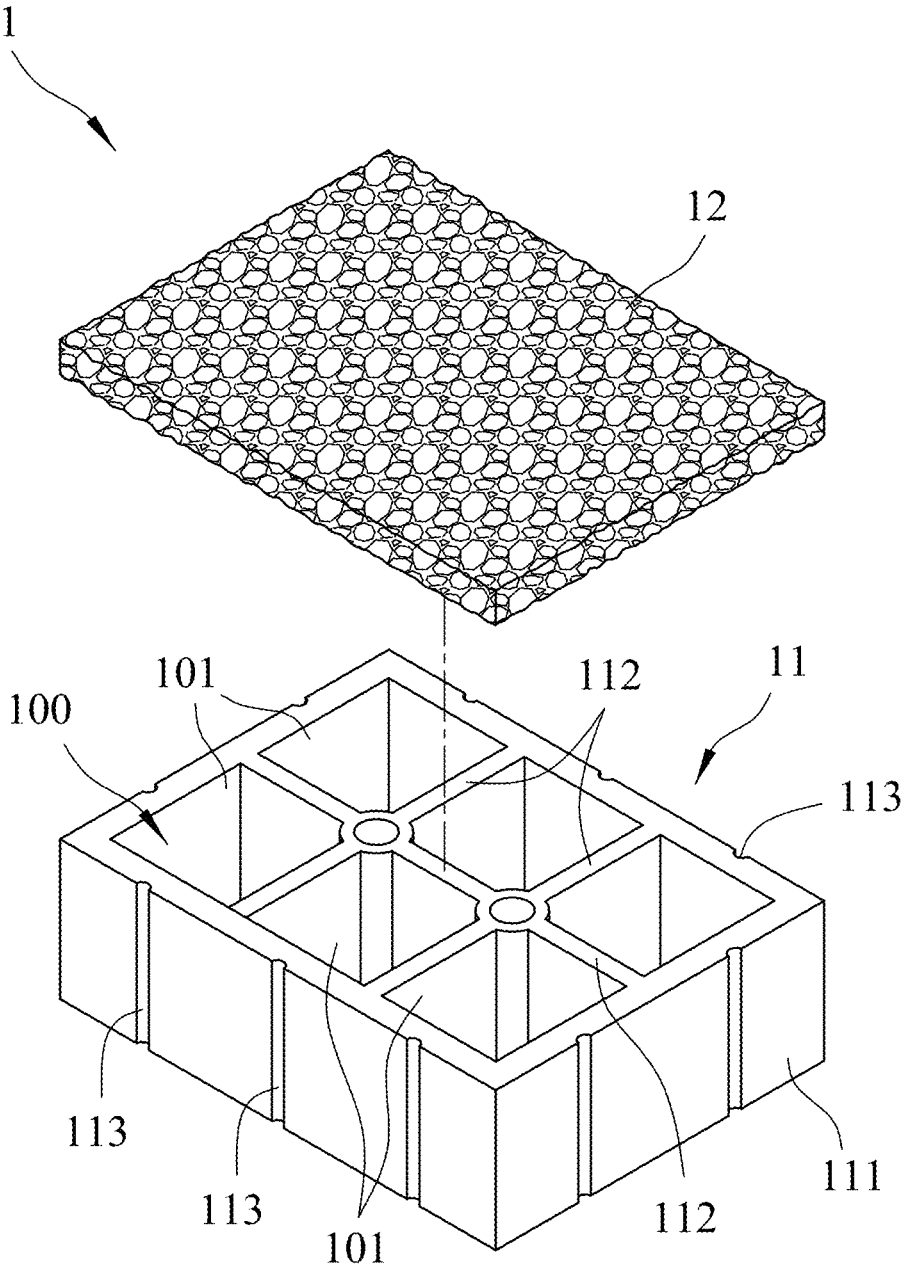
FIG.1 PRIOR ART
FIG. 1 is an exploded perspective view illustrating an existing brick.
Figure 2:
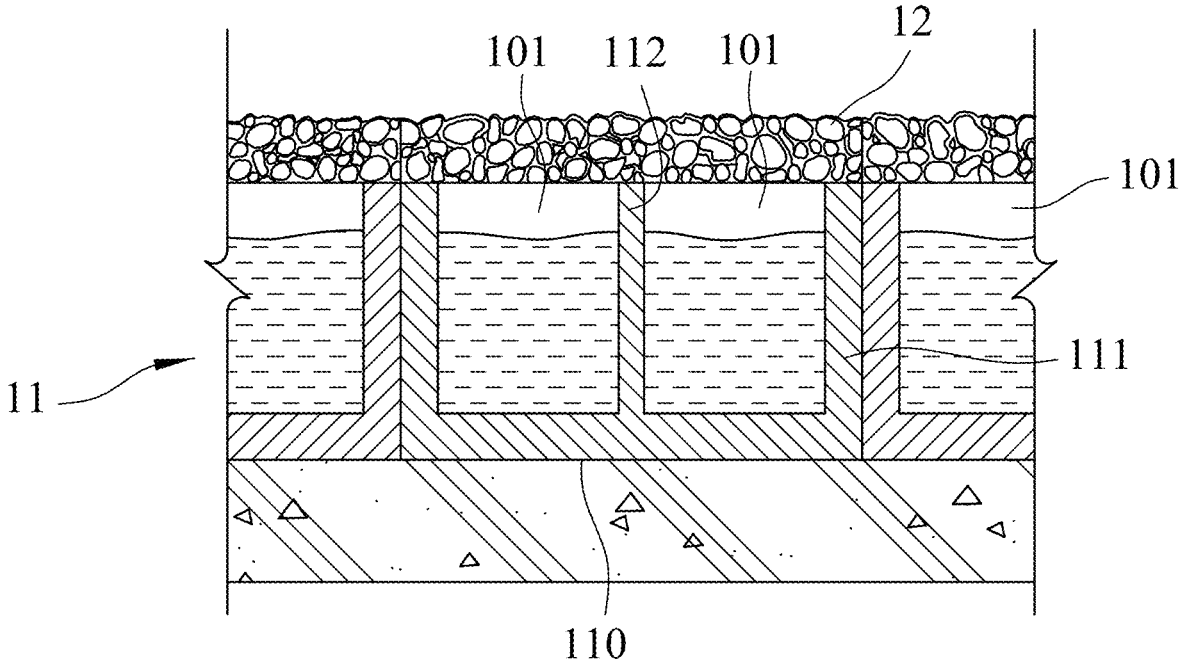
FIG.2 PRIOR ART
FIG. 2 is a fragmentary sectional view illustrating the existing bricks juxtaposed each other.
Figure 3:
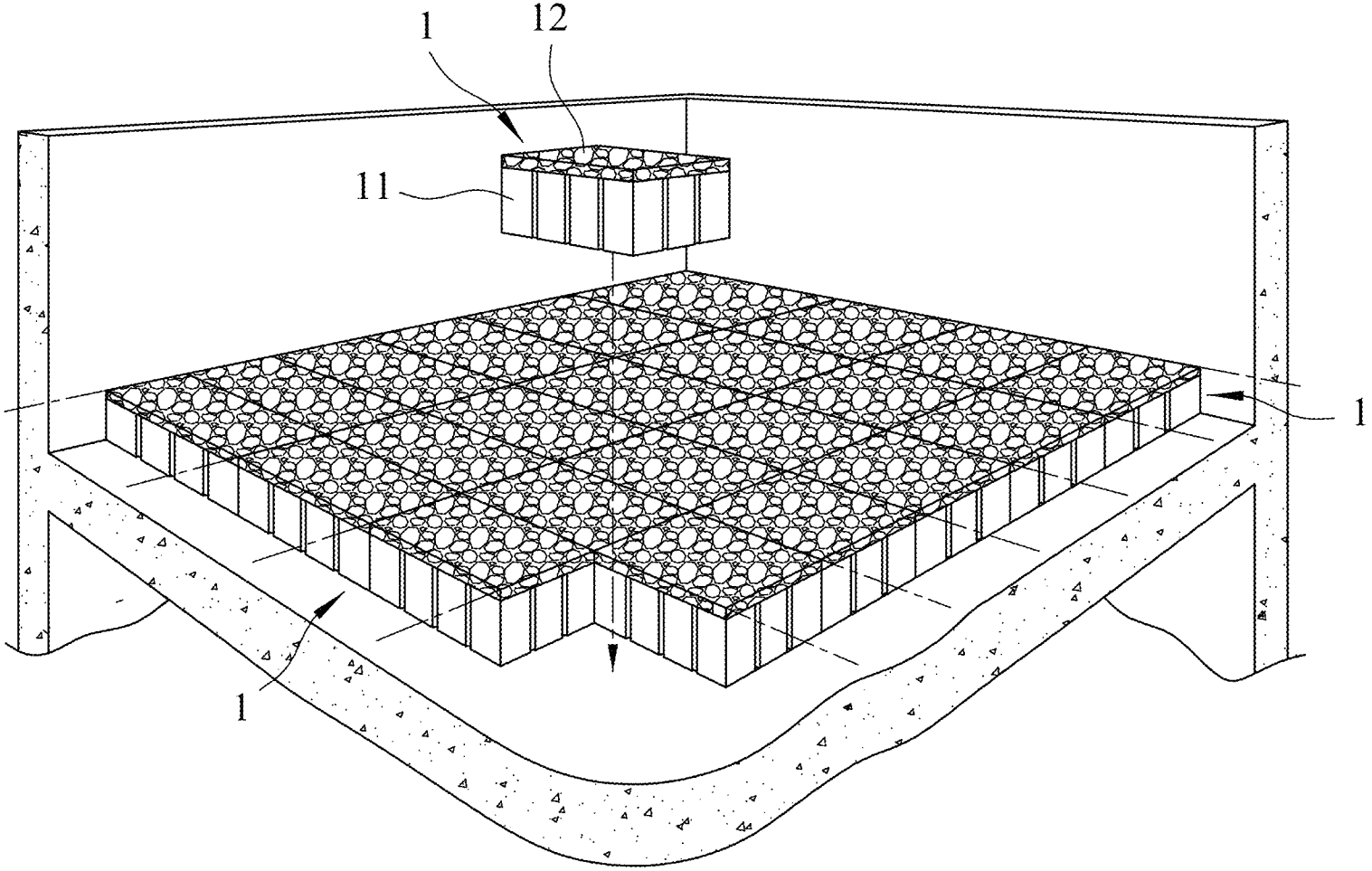
FIG.3 PRIOR ART
FIG. 3 is a perspective view illustrating the existing bricks arranged in rows and columns.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
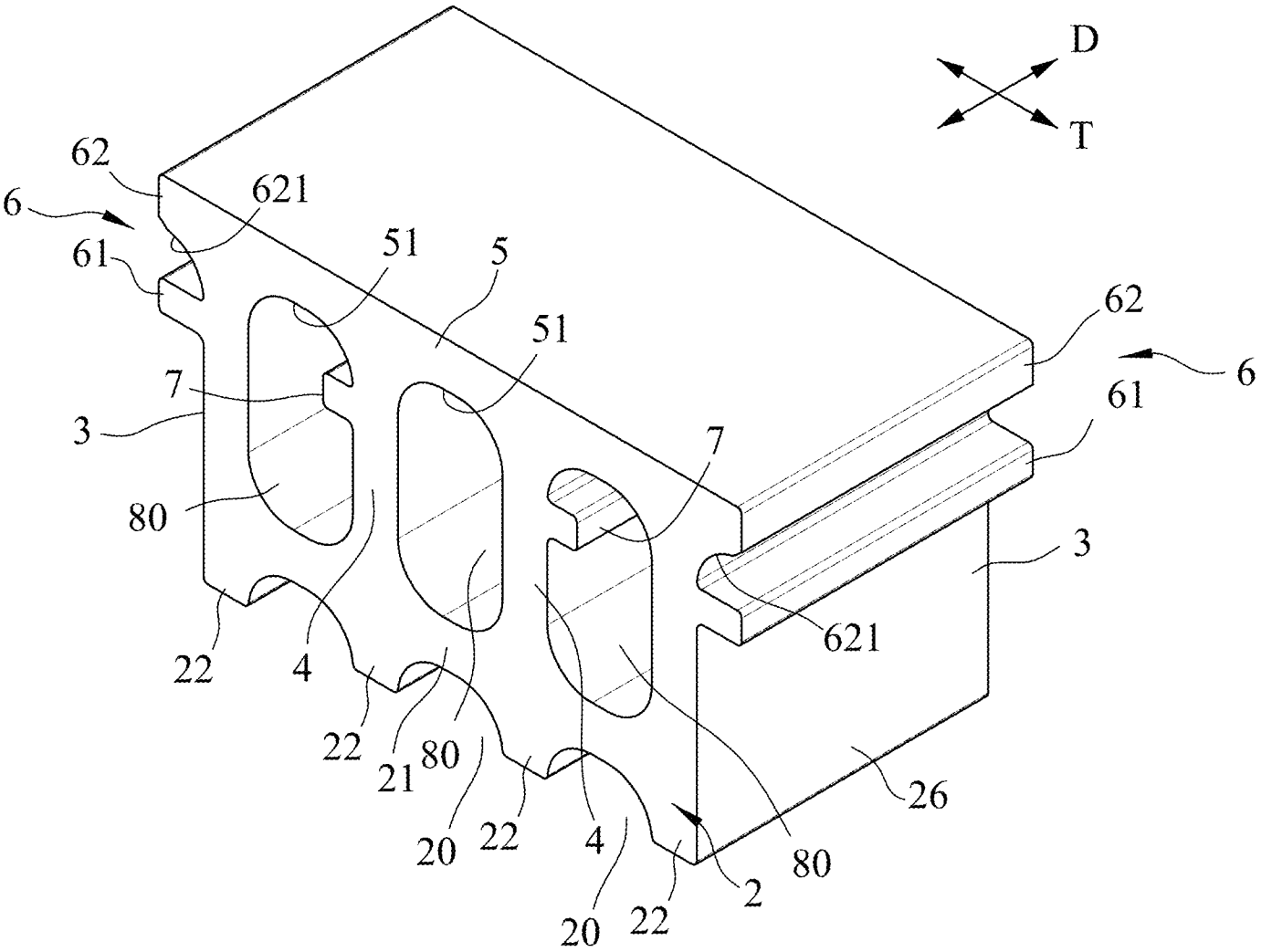
FIG. 4 is a perspective view illustrating a first embodiment of a hollow brick according to the disclosure.
Figure 5:
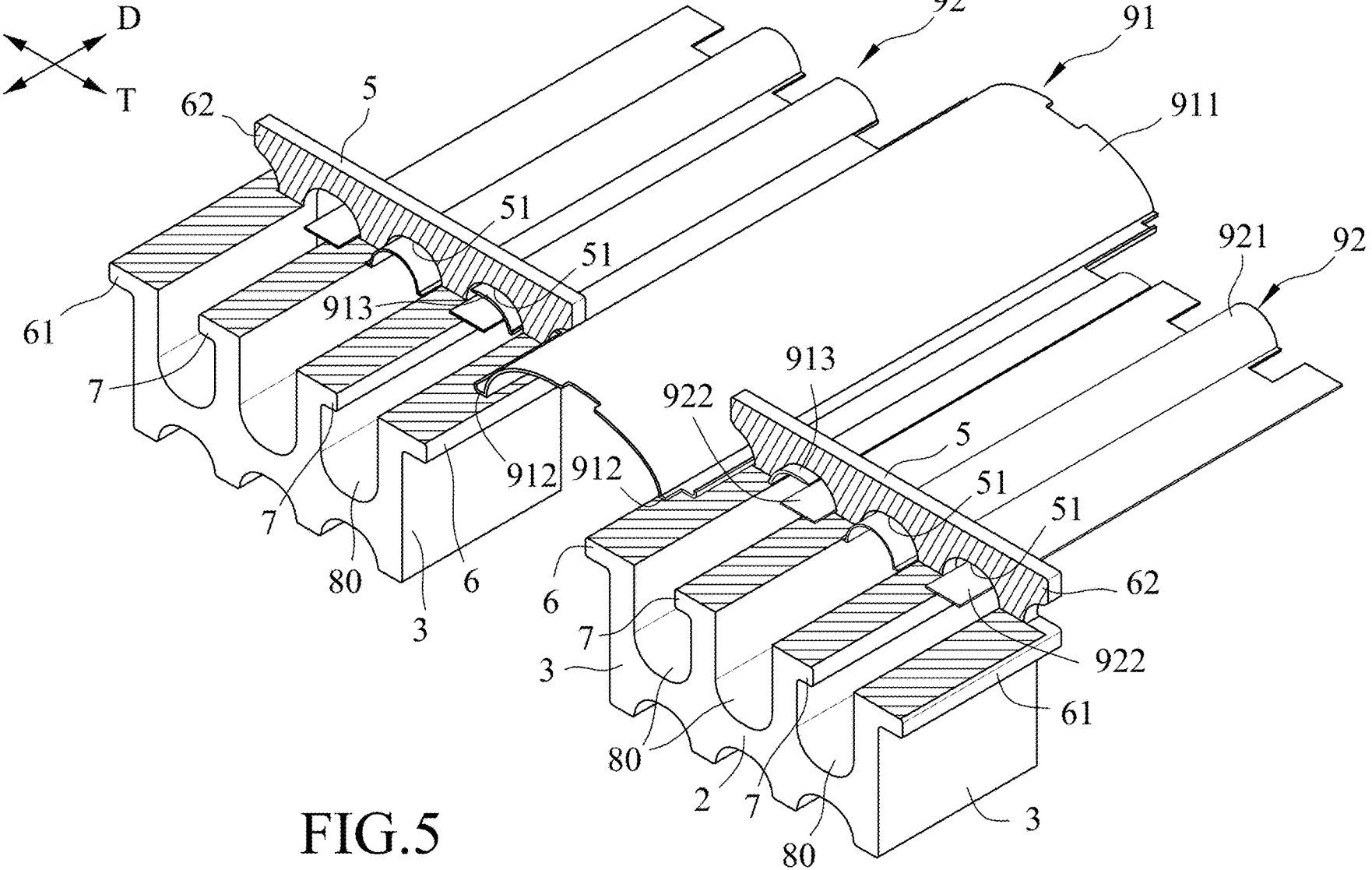
FIG. 5 is a partly sectional perspective view of the first embodiment illustrating two adjacent hollow bricks assembled with first and second corrugated plates.

FIGS. 4 to 7 illustrate a hollow brick of a first embodiment according to the disclosure. The hollow brick is configured to be assembled with first and second corrugated plates 91, 92 on a rooftop. As shown in FIG. 5, each of two opposite sides of the first corrugated plate 91 has a curved connection portion 911, an extension portion 912 extending outwardly from the curved connection portion 911 and a curved insertion portion 913 curvedly and upwardly extending from the extension portion 912 opposite to the curved connection portion 911. The second corrugated plate 92 has two lateral portions 922 and a curved middle portion 921 between the lateral portions 922.

In this embodiment, the hollow brick of the disclosure includes a bottom wall 2, two side walls 3, two intermediate walls 4, a top wall 5, three ventilation holes 80, two supports 6, and two inner holding ribs 7.

The bottom wall 2 has two opposite longitudinal sides 21 (only one shown in FIG. 4) and two opposite transverse sides 26 connected between the longitudinal sides 21.

The side walls 3 respectively and upwardly project from two opposite transverse sides 26 of the bottom wall 2.

The intermediate walls 4 project upwardly from the bottom wall 2 between the side walls 3 and spaced apart along a direction parallel with the longitudinal sides 21 of the bottom wall 2.

The top wall 5 is opposite to the bottom wall 2 and connects the side walls 3 and the intermediate walls 4.

In this embodiment, the bottom wall 2 has a plurality of foot portions 22 projecting downwardly from the longitudinal sides 21 and spaced apart from each other, and a plurality of bottom grooves 20 each of which is located between two adjacent ones of the foot portions 22. A central axial line of each of the foot portions 22 is collinearly aligned with a central axial line of one of the side walls 3 and the intermediate walls 4. When the top wall 5 sustains an external force, the external force will be dispersedly transmitted to the foot portions 22, thereby optimizing the bearing capacity of the hollow brick.

Figure 7:
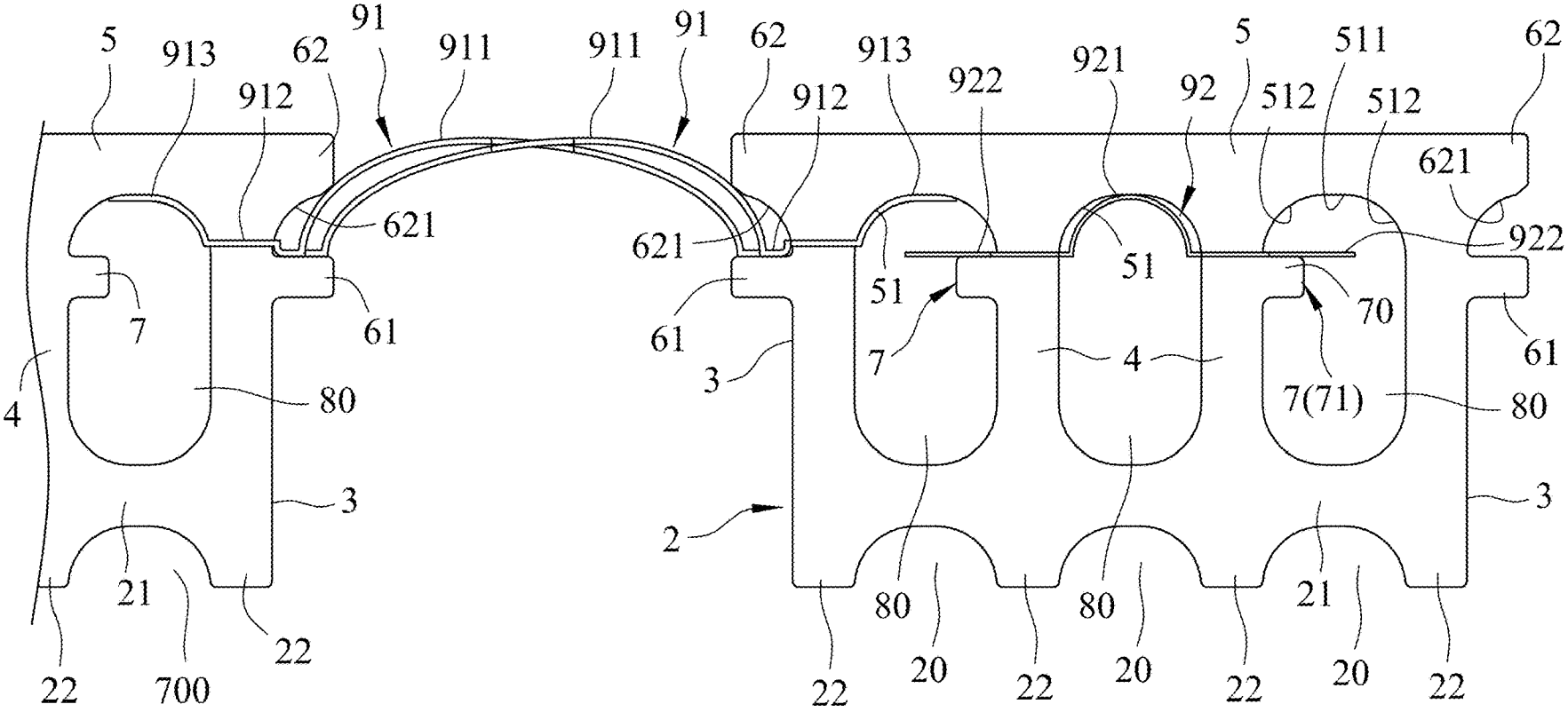
FIG. 7 is a fragmentary front view of the first embodiment.

The three ventilation holes 80 are bounded by the bottom wall 2, the side walls 3, the intermediate walls 4 and the top wall 5. Each of the ventilation holes 80 has two ventilation open ends opposite to each other along a line parallel with the transverse sides 26 of the bottom wall 2. A bottom side of the top wall 5 defines three arched top boundary surfaces 51 each of which is concaved upwardly to bound a top portion of a respective one of the ventilation holes 80. As shown in FIG. 7, each of the arched top boundary surfaces 51 has a flat portion 511 and two arcuate portions 512 curved respectively and downwardly from two opposite ends of the flat portion 511.

As shown in FIG. 7, each of the supports 6 has an outer holding rib 61 and an outer flange 62. The outer holding ribs 61 of the two supports 6 project respectively from outer surfaces of the side walls 3 in opposite outward directions. The outer flanges 62 of the two supports 6 respectively project in opposite outward directions from the outer surfaces of the side walls 3 at a level above the outer holding ribs 61. The outer holding rib 61 and the outer flange 62 of each support 6 are proximal to the top wall 5 and cooperatively define a space therebetween. Each of the outer holding ribs 61 has a top flat surface that faces toward the respective one of the outer flanges 62. Each of the outer flanges 62 has a flange bottom side formed into a lateral curved surface 621 that curvedly extends to a junction of the top flat surface of the respective one of the outer holding ribs 61 and the respective one of the side walls 3.

The two inner holding ribs 7 are respectively disposed in two of the ventilation holes 80 respectively proximal to the side walls 3. Each of the inner holding ribs 7 projects from one of the intermediate walls 4 toward an adjacent one of the side walls 3. Each of the inner holding ribs 7 lying at a level below a respective one of the arched top boundary surfaces 51. Further, each inner holding rib 7 has a joining end 70 fixed to the corresponding one of the intermediate walls 4, and a free end 71 opposite to the joining end 70 and spaced apart from the adjacent one of the side walls 3.

As shown in FIG. 7, the inner holding ribs 7 are at the same level as the outer holding ribs 61. The lateral curved surfaces 621 of the outer flanges 62 and the arched top boundary surfaces 51 of the top wall 5 have the same height from a level of the outer and inner holding ribs 61, 7. The lateral curved surface 621 of each of the outer flanges 62 has a curvature same as that of each of the arched top boundary surfaces 51.

Figure 6:
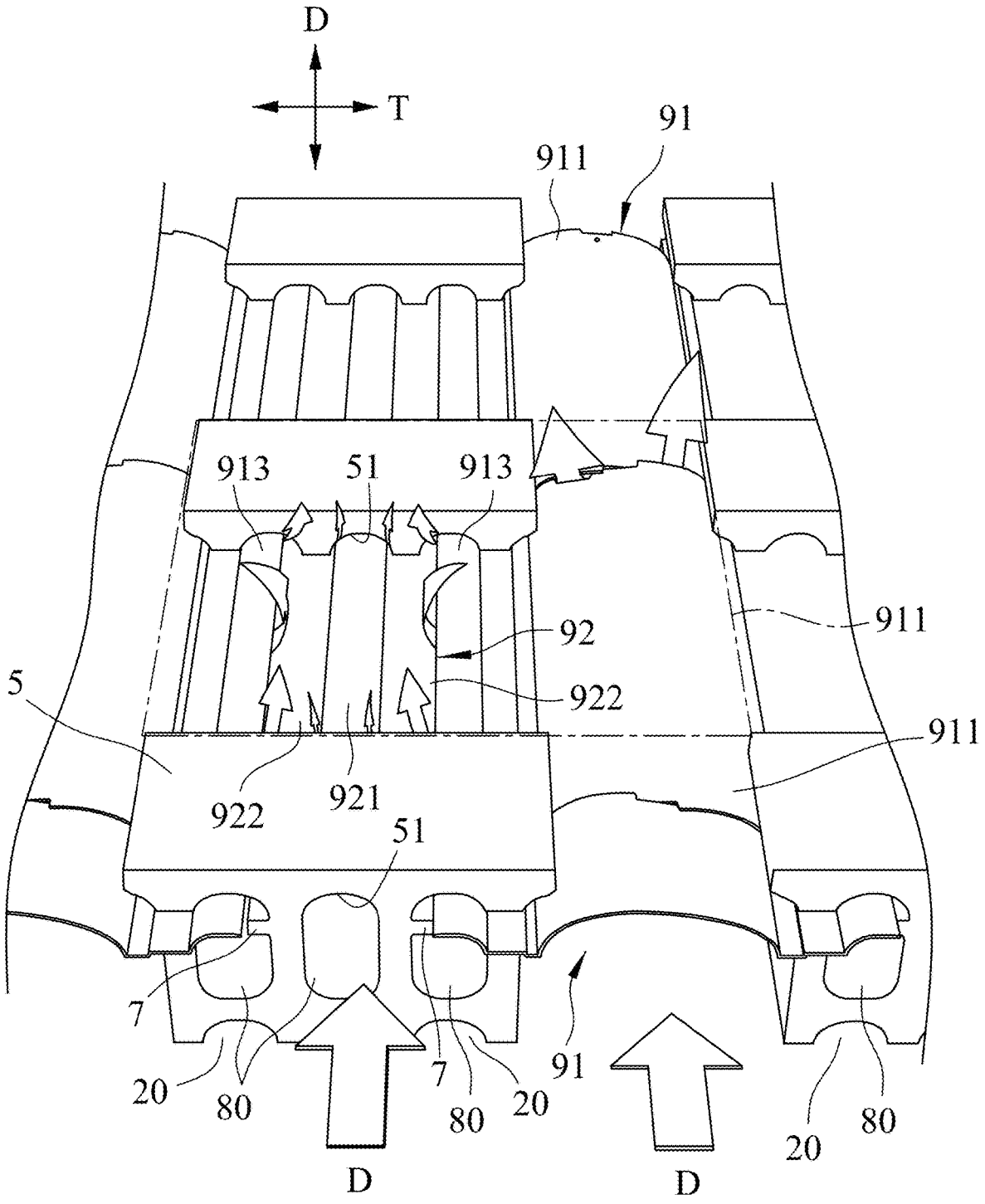
FIG. 6 is an exploded perspective view of the first embodiment illustrating air flow paths formed by the first corrugated plates, the second corrugated plates and the hollow bricks.

Referring to FIG. 5, in combination with FIG. 4, two hollow bricks of the disclosure are assembled with the first and second corrugated plates 91, 92 to constitute a ventilation and temperature-adjustment structure on the rooftop. Each of the first and second corrugated plates 91, 92 is made of plastic and flexible. When the first corrugated plate 91 is assembled between two adjacent hollow bricks arranged along a longitudinal direction (T), two opposite sides of the first corrugated plate 91 are inserted along a transverse direction (D) into the spaces defined by the outer holding ribs 61 and the outer flanges 62 of the supports 6 of the two adjacent hollow bricks. The outer ribs 61 lift the extension portions 912 of the first corrugated plate 91 whereas the outer flanges 62 press the curved connection portions 911 of the first corrugated plate 91. In each of the two adjacent hollow bricks, the arched top boundary surface 51 of one of the ventilation holes 80 adjacent to one of the side walls 3 abuts and presses the respective curved insertion portion 913 of the first corrugated plate 91 when the respective curved insertion portion 913 is inserted therein. Accordingly, the first corrugated plate 91 is positioned in a bridging manner between the two adjacent hollow bricks of the disclosure disposed along the longitudinal direction (T). As shown in FIG. 6, when a number of the hollow bricks are arranged in rows and columns along the longitudinal and transverse directions (T, D), a plurality of the first corrugated plates 91 are arranged along the transverse direction (D). By virtue of the arched top surfaces 51 and the supports 6, an effective positioning of each first corrugated plate 91 between the two adjacent hollow bricks arranged in the longitudinal direction (T) can be ensured.

Referring back to FIGS. 5 and 7, as the second corrugated plate 92 is assembled to the hollow brick along the transverse direction (D), the flat portion 511 of the arched top boundary surface 51 of one of the ventilation holes 80 between the intermediate walls 4 abuts and presses the curved middle portion 921 of the second corrugated plate 92, and the inner holding ribs 7 lift the lateral portions 922 of the second corrugated plate 92. As shown in FIG. 6, the second corrugated plate 92 bridges two hollow bricks spaced apart along the transverse direction (D). By using the first and second corrugated plates 91, 92, the hollow bricks of the disclosure may be interconnected along intersecting rows to form the ventilation and temperature-adjustment structure for the rooftop.

Figure 8:
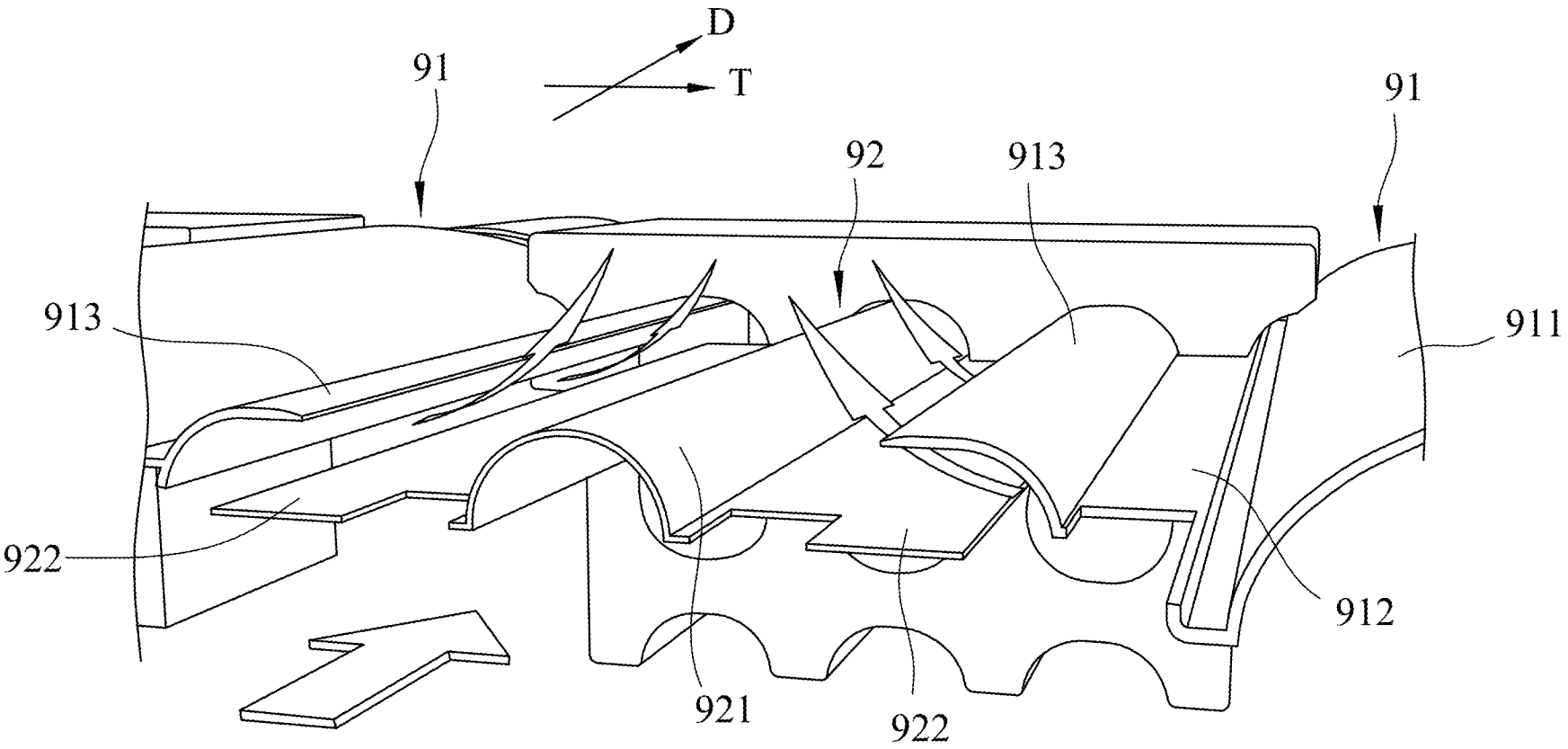
FIG. 8 is an exploded perspective view of the first embodiment illustrating air flow paths formed between the first corrugated plates and the second corrugated plates.

FIG. 8, in combination with FIGS. 6 and 7, illustrates the ventilation and temperature-adjustment structure composed of the hollow bricks of the disclosure and the first and second corrugated plates 91, 92. The ventilation holes 80 and the bottom grooves 20 provide ventilation effects along the transverse direction (D). Further, by virtue of the first and second corrugated plates 91, 92 each connected to two adjacent hollow bricks of the disclosure, additional ventilation paths can be formed between the hollow bricks of the disclosure. Therefore, ventilation, heat-dissipation and heat-insulation effects are enhanced along the longitudinal and transverse directions (T, D) when the hollow bricks are assembled with the first and second corrugated plates 91, 92.

Figure 9:
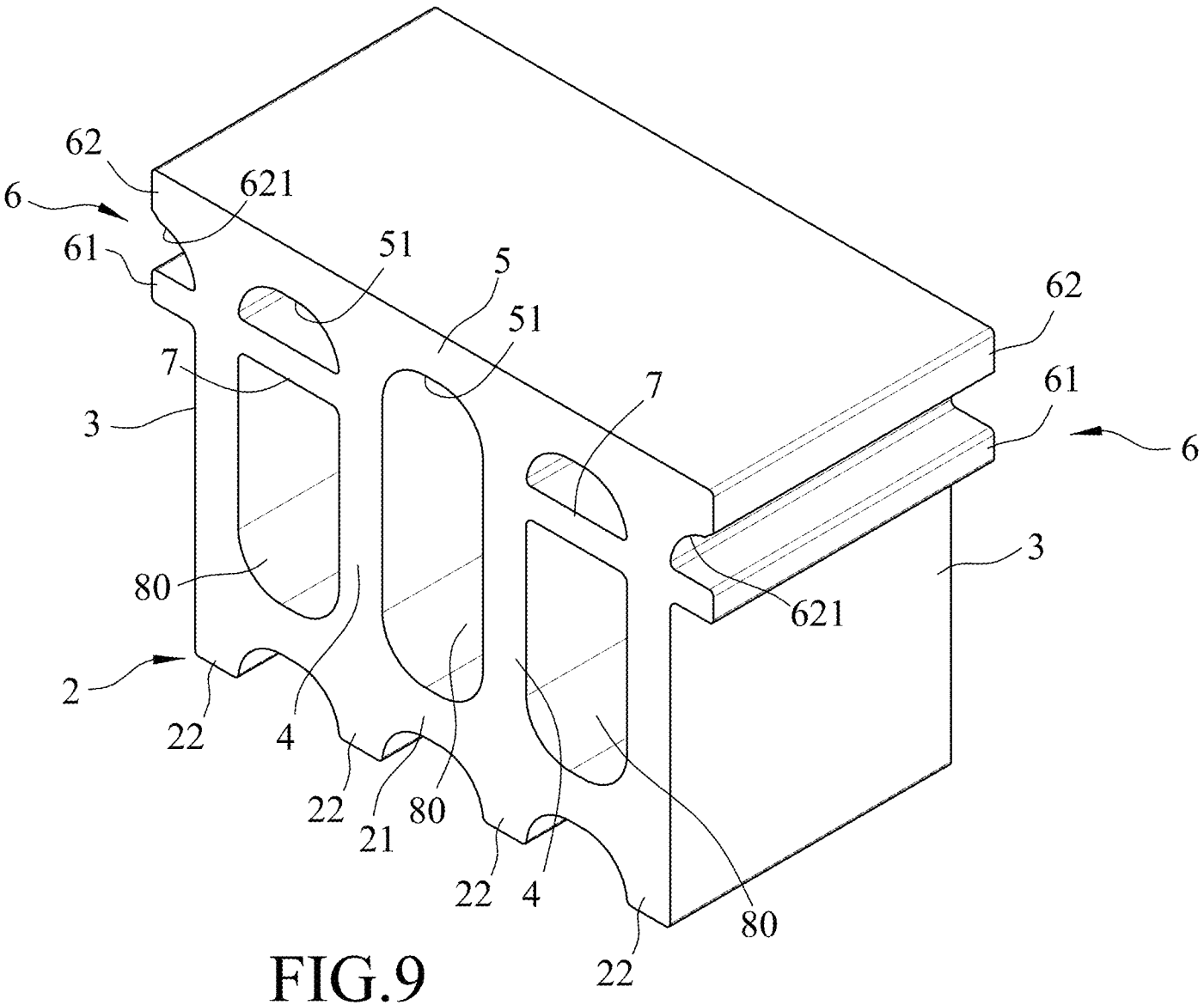
FIG. 9 is a perspective view illustrating a second embodiment of a hollow brick according to the disclosure.

FIG. 9 illustrates a second embodiment of a hollow brick according to the disclosure, which has a structure generally similar to that of the first embodiment. However, in this embodiment, each of the inner holding ribs 7 projects from one of said intermediate walls 4 and joins the adjacent one of said side walls 3. In other words, each inner holding rib 7 connects one of the intermediate walls 4 and an adjacent one of the side walls 3 to bridge the ventilation hole 80 defined therebetween. Therefore, the hollow brick of the disclosure is structurally strengthened. Further in this embodiment, a ratio of the height of the side walls 3 and the intermediates walls 4 to the width of the hollow brick is increased. As such, the size of the ventilation holes 80 is enlarged, and the height of the top wall 5 from a support surface is increased so as to match with the height of a surrounding wall of a building (e.g., a parapet wall) for providing an entranced ventilation.

Figure 10:
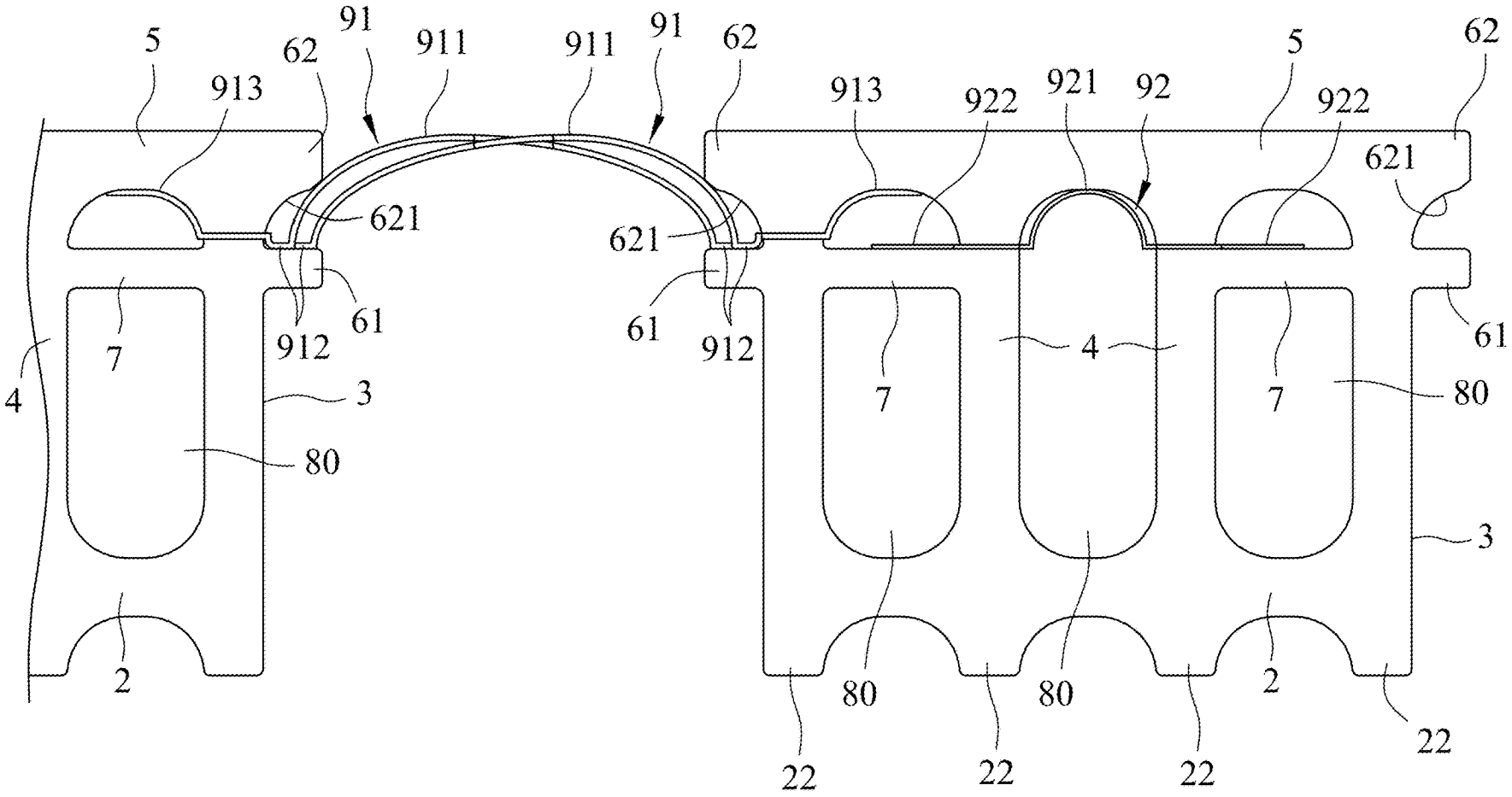
FIG. 10 is a front view of the second embodiment illustrating two adjacent hollow bricks associated with the first and second corrugated plates.

As shown in FIG. 10, though the inner holding ribs 7 of the second embodiment are different in configuration from that of the first embodiment, the two lateral portions 922 of the second corrugated plate 92 are also allowed to be respectively seated on the inner holding ribs 7 of the corresponding hollow brick of the second embodiment.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A hollow brick configured to be assembled with a first corrugated plate and a second corrugated plate on a rooftop, each of two opposite sides of the first corrugated plate having a curved connection portion, an extension portion extending outwardly from the curved connection portion and a curved insertion portion curvedly and upwardly extending from the extension portion opposite to the curved connection portion, the second corrugated plate having two lateral portions and a curved middle portion between the lateral portions, the hollow brick comprising:

a bottom wall having two opposite longitudinal sides and two opposite transverse sides connected between said longitudinal sides;

two side walls respectively and upwardly projecting from two opposite transverse sides of said bottom wall;

two intermediate walls projecting upwardly from said bottom wall between said side walls and spaced apart along a direction parallel with said longitudinal sides of said bottom wall;

a top wall opposite to said bottom wall and connecting said side walls and said intermediate walls;

three ventilation holes bounded by said bottom wall, said side walls, said intermediate walls and said top wall, each of said ventilation holes having two ventilation open ends opposite to each other along a line parallel with said transverse sides of said bottom wall, a bottom side of said top wall defining three arched top boundary surfaces each of which is concaved upwardly to bound a top portion of one of said ventilation holes;

two supports each having an outer holding rib and an outer flange, said outer holding ribs of said two supports projecting respectively from outer surfaces of said side walls in opposite outward directions, said outer flanges of said two supports respectively projecting in opposite outward directions from said outer surfaces of said side walls at a level above said outer holding ribs, said outer holding rib and said outer flange of each of said supports being proximal to said top wall and defining a space therebetween, one of said outer ribs being adapted to lift the extension portion of the first corrugated plate whereas one of said outer flanges is adapted to press the curved connection portion of the first corrugated plate, said arched top boundary surface of one of said ventilation holes adjacent to one of said side walls being adapted to abut and press the curved insertion portion of the first corrugated plate when the curved insertion portion is inserted therein;

two inner holding ribs respectively disposed in two of said ventilation holes respectively proximal to said side walls, each of said inner holding ribs projecting from one of said intermediate walls toward an adjacent one of said side walls, each of said inner holding ribs lying at a level below a respective one of said arched top boundary surfaces; and wherein said arched top boundary surface of one of said ventilation holes between said intermediate walls is adapted to abut and press the curved middle portion of the second corrugated plate, and said inner holding ribs are adapted to respectively lift the lateral portions of the second corrugated plate;

wherein each of said outer holding ribs has a top flat surface that faces toward one of said outer flanges and is configured to support the extension portion of the first corrugated plate; and wherein each of said outer flanges has a flange bottom side formed into a lateral curved surface that curvedly extends to a junction of said top flat surface of one of said outer holding ribs and one of said side walls, said lateral curved surface being adapted to abut the curved connection portion of the first corrugated plate.

2. The hollow brick as claim in claim 1, wherein said bottom wall has a plurality of foot portions projecting downwardly from said longitudinal sides and spaced apart from each other, and a plurality of bottom grooves each of which is located between two adjacent ones of said foot portions.

3. The hollow brick as claim in claim 1, wherein said inner holding ribs are at the same level as said outer holding ribs.

4. The hollow brick as claimed in claim 3, wherein said lateral curved surfaces of said outer flanges and said arched top boundary surfaces of said top wall have the same height from a level of said outer and inner holding ribs, said lateral curved surface of each of said outer flanges having a curvature same as that of each of said arched top boundary surfaces.

5. The hollow brick as claimed in claim 1, wherein each of said arched top boundary surfaces has a flat portion and two arcuate portions curved respectively and downwardly from two opposite ends of said flat portion.

6. The hollow brick as claimed in claim 1, wherein each of said inner holding ribs projects from one of said intermediate walls and joins said adjacent one of said side walls.

* * * * *